US006405649B1

(12) United States Patent
Fina

(10) Patent No.: US 6,405,649 B1
(45) Date of Patent: Jun. 18, 2002

(54) INK FOUNTAIN BLADE FOR A PRINTING MACHINE

(75) Inventor: Raffaele Fina, Lausanne (CH)

(73) Assignee: De La Rue Giori S.A., Lausanne (CH)

( * ) Notice: Subject to any disclaimer, the term of this patent is extended or adjusted under 35 U.S.C. 154(b) by 0 days.

(21) Appl. No.: 09/507,443

(22) Filed: Feb. 19, 2000

Related U.S. Application Data

(63) Continuation-in-part of application No. 09/483,815, filed on Jan. 15, 2000.

(30) Foreign Application Priority Data

Feb. 23, 1999 (CH) ..... 0338/99

(51) Int. Cl.[7] ..... B41F 31/02
(52) U.S. Cl. ..... 101/364; 101/169
(58) Field of Search ..... 101/364, 365, 101/367, 148, 154, 155, 156, 157, 167, 168, 169

(56) References Cited

U.S. PATENT DOCUMENTS

| | | | | |
|---|---|---|---|---|
| 2,887,049 A | * | 5/1959 | Mueller | 101/364 |
| 4,328,748 A | | 5/1982 | Schramm | |
| 4,393,775 A | | 7/1983 | Cappel et al. | |
| 4,711,175 A | | 12/1987 | Hummel et al. | |
| 4,991,504 A | | 2/1991 | Fina | |
| 5,243,907 A | * | 9/1993 | Weishew | 101/208 |

FOREIGN PATENT DOCUMENTS

| | | |
|---|---|---|
| DE | 110632 | 1/1975 |
| DE | 2951653 A | 7/1981 |
| DE | 3503736 C | 12/1985 |
| DE | 8208651 U | 8/1986 |
| EP | 0 046 206 A | 2/1982 |
| EP | 0 600 435 | 6/1994 |
| FR | 419 472 | 10/1910 |

OTHER PUBLICATIONS

Copy of US Pat. App. No. 09/483815, submitted as an English translation of Swiss Application No. CH 105/99.*

* cited by examiner

*Primary Examiner*—Eugene Eickholt
(74) *Attorney, Agent, or Firm*—Bugnion S.A.; John Moetteli

(57) ABSTRACT

The side wall (5) for an ink fountain of a printing machine has two plates (11, 14) fixed some distance apart and an intermediate plate (13) having a front edge **(13*a*) in the shape of an arc of a circle. This intermediate plate (3) is mounted between the plates in such a way that it can be shifted and tilted. The front edge of this plate contacts the circumference of an ink fountain roller (6) via springs (18, 19) acting on the intermediate plate. The wall has a slideway (10) in which the plates (11, 14, 13) are mounted. The slideway has a reinforced region (12) on one of its sides which is proximate the ink fountain roller (6). The side wall (5) thus more effectively seals an ink fountain against leakage. The blade at the bottom of the ink fountain is split into several adjacent sectors (111) that can be shifted so as to vary the distance between the edge (112) of the blade and the circumference of the ink fountain roller (6). The sectors (111)** can be shifted in the plane of the blade, parallel to each other.

9 Claims, 6 Drawing Sheets

INK FOUNTAIN BLADE FOR A PRINTING MACHINE

This is a continuation-in-part application of U.S. Ser. No. 09/483,815 filed Jan. 15, 2000 by the same inventor and entitled SIDE WALL FOR AN INK FOUNTAIN OF A PRINTING MACHINE, the contents of which are incorporated herein by reference.

BACKGROUND OF THE INVENTION

The present invention relates to an ink fountain for a printing machine, said ink fountain comprising an ink fountain roller, a bottom in the form of a blade, the edge of which is close to the ink fountain roller circumference, and two side walls in contact with the bottom of the ink fountain and sealing the sides of the ink fountain. The blade's edge is intended to maintain a determined thickness of ink on an ink fountain roller, said blade being split into several adjacent sectors that can be shifted so as to vary the distance between the edge of the blade and the circumference of the ink fountain roller.

These blades and ink fountains are used mainly in intaglio printing machines in which the amount of ink applied to the ink fountain roller is great, so as to adequately ink the intaglio cuts in the printing plates.

Ink fountain blades and ink fountains of this type are known in the state of the art. For example, patent DD 110 632, the content of which is incorporated by reference, discloses an ink fountain, the bottom of which has a blade which is close to the circumference of the ink fountain roller. In order to vary the distance between the edge of the blade and the roller, that is to say the thickness of ink applied to the roller, the blade is deformed elastically by screws which press against the blade, on the other side thereof with respect to the ink fountain roller.

The major disadvantage of this system lies in the fact that the deformation of the blade does not allow a constant thickness of ink to be applied. This is because the profile of the deformed blade has, roughly speaking, a rounded shape because the screws press at a point location on the blade, which means that the metering of the ink is thus inaccurate.

Another system is described in patent application EP 0 600 435, the content of which is incorporated by reference. In this system, the ink fountain blade is formed of several adjacent bladelets which can be elastically deformed in order to modify the thickness of ink applied to the ink fountain roller. To obtain this deformation, use is here too made of a lever on the other side of the bladelets with respect to the ink fountain roller in order to move them closer to this roller and thus alter the distance between the edge of each bladelet and the circumference of the ink fountain roller and thus the thickness of ink applied.

This system has several drawbacks, particularly the fact that the deformation of the bladelets occurs toward the ink fountain roller. Thus, in the event of an error of manipulation, there is the risk that the blade will come into contact with the roller and damage it. The deformation of the blades also leads to fatigue in the material and this may create problems of premature wear.

SUMMARY OF THE INVENTION

The purpose of the invention is to improve the known systems.

More specifically, the object of the present invention is to provide an ink fountain in which the sealing of the side walls is markedly improved, and to do so in a simple manner and at fairly low cost. Another object of the present invention is to provide a system which can be retrofitted to existing machines, that is to say a system which can be mounted in ink fountains which are already in service without major modification thereto. Another object is to provide a segmented fountain blade which has a fine adjustment to allow a constant thickness of ink to be applied to the ink fountain roller, precisely, repeatably and without risk of damaging the roller.

The invention is characterized by the fact that the sectors forming the blade at the bottom of the ink fountain can be moved in the plane of the blade parallel to one another.

The advantages afforded by the use of a blade split into sectors according to the invention are many. Mention may, in particular, be made of the fact that the movement of the sectors is linear, which means that it is easier to control and to measure than the movement of the bladelets described in patent application EP 0 600 435. Specifically, any arbitrary point on a blade sector according to the invention has the same movement, whereas in the case of the bladelets known from the prior art, a precise measurement of the movement could be made only on the actual edge of each bladelet.

The invention will be better understood from the description of one embodiment thereof and from the figures pertaining thereto.

DESCRIPTION OF THE PREFERRED EMBODIMENTS

Figure 1:
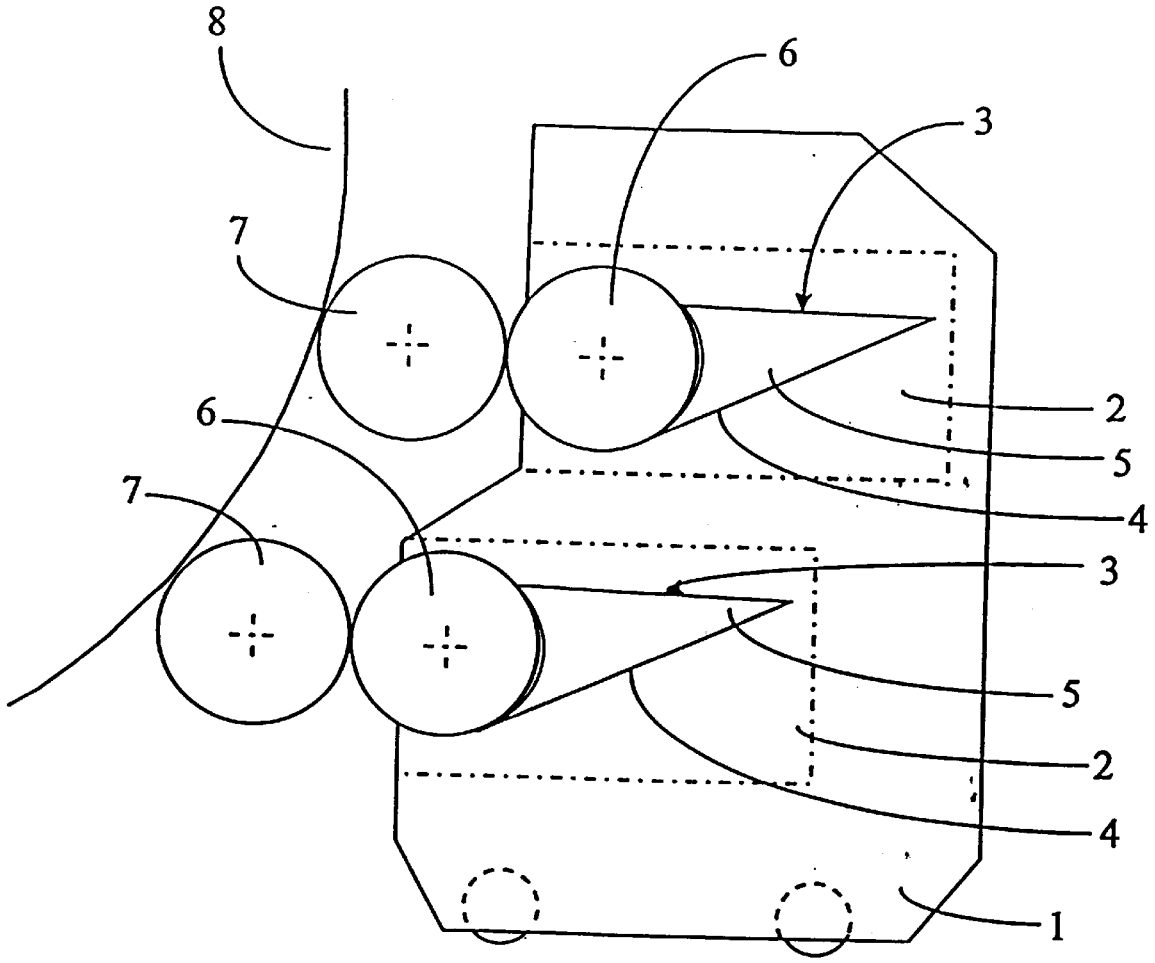
FIG. 1 diagramatically shows an inking device comprising two ink fountains.

FIG. 1 depicts an inking device with two superposed ink fountains, of the type used in intaglio printing machines. This device is made up mainly of a mobile linking carriage 1, comprising two superposed frames 2, each frame 2 being equipped with an ink fountain 3 formed of a bottom 4 and of two side walls 5 collaborating with the ink fountain roller 6. The bottom 4 is formed of a blade, the front edge of which is close to the ink fountain roller 6. To illustrate one application of this ink fountain 3, FIG. 1 also diagrammatically depicts inking rollers 7 which, for example, ink impression plates (not depicted) mounted in a plate cylinder 8.

Figure 2:
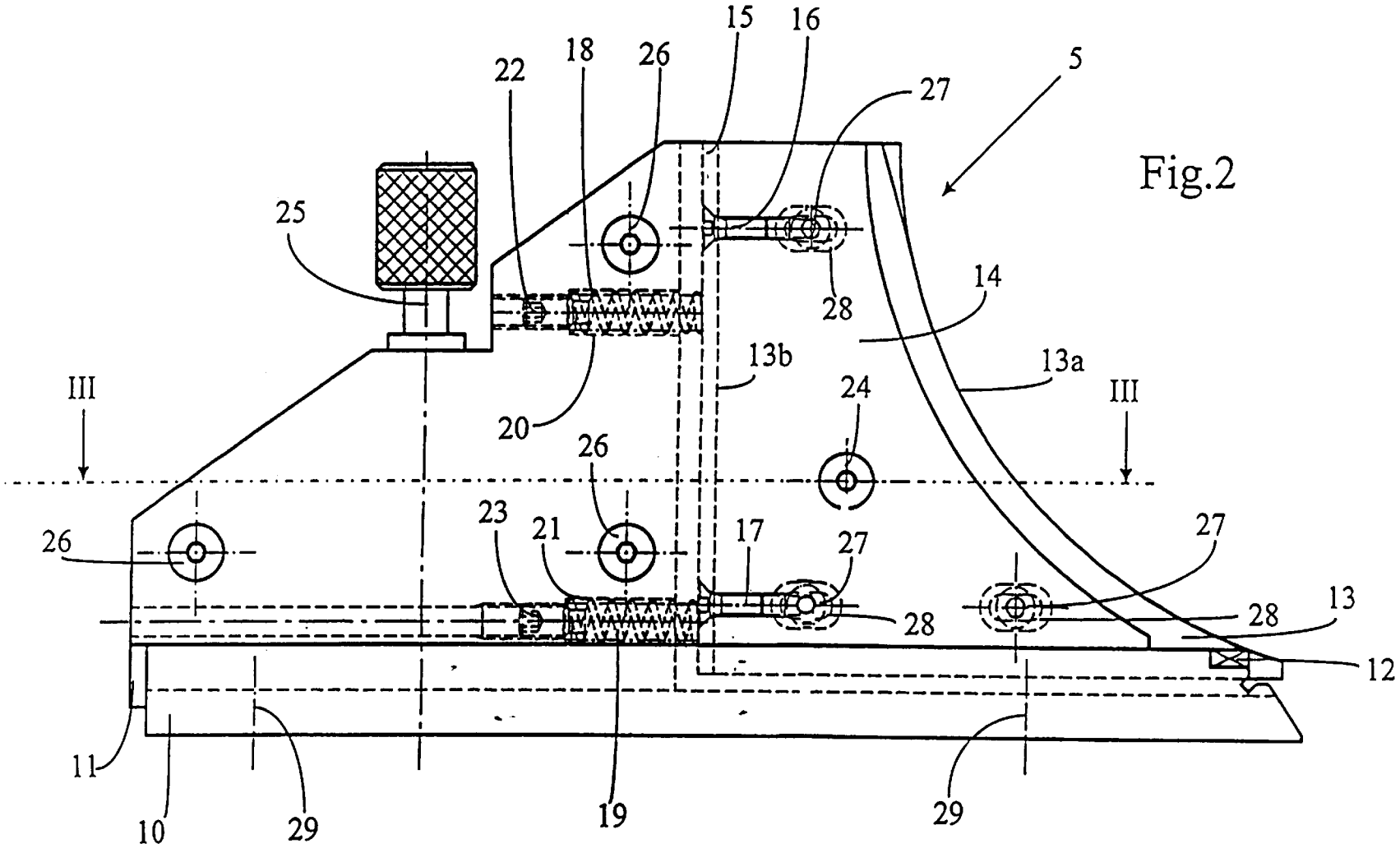
FIG. 2 shows a view in part section of a side wall of an ink fountain, from the inside of the ink fountain.

FIG. 2 is a detailed depiction of a side wall 5 seen from inside the ink fountain 3.

This side wall 5 comprises a slideway 10 which is mounted on the bottom of the ink fountain 3, for example by a screw-fastening using screws 29. The front end of the slideway 10 which is on the inside of the ink fountain 3 is in contact with the ink fountain roller 6. The slideway 10 at this point has a reinforcement 12, such as a small plate of hard material, for example metal or ceramic, which completely seals the joint between this wedge shape and the roller 6.

Specifically, as the front edge of the slideway is in contact with the periphery of the ink fountain roller 6, the sharp edge of the slide way is blunted because of the abrasive properties of the ink, which means that ink can run near the seal with the side wall 5. Thus, to improve the sealing of this seal, a housing is milled on the inside end of the slideway, in which housing the small plate of hard material 12 is fixed, and wear is markedly reduced.

The side wall 5 itself comprises a first plate 11 which slides without play in said slideway 10, from the opposite end to the ink fountain roller 6. Mounted next on this first plate is an intermediate plate 13, the front edge 13*a* of which is in the shape of an arc of a circle and which plate is intended to come into contact with the circumference of the ink fountain roller 6. This intermediate plate is generally made of plastic, for example "NYLATRON", and provides for the sealing of the side wall 5 along the circumference of the ink fountain roller 6.

This intermediate plate 13 can move longitudinally, in the direction perpendicular to the axis of rotation of the ink fountain roller 6 or in terms of rotation about an axis parallel to the axis of rotation of the ink fountain roller 6 and is kept pressed against the ink fountain roller 6 by means of the two springs 18 and 19, placed in corresponding cavities 20, 21 in the first plate 11. The axis of rotation of the intermediate plate 13 is close to or even coincident with the axis of a screw 24, depending on the longitudinal position of the intermediate plate 13. Furthermore, the two springs 18 and 19 are located one on each side of this axis of rotation of the intermediate plate 13. As a preference, the two springs 18, 19 may be preloaded by screws 22, 23. To protect the rear portion 13*b* of the intermediate plate 13 on which the two springs 18, 19 act, a small protective plate 15 is placed on said rear portion 13*b*, and held in place, for example using screws 16 and 17.

A second plate 14 is fixed to the first plate 11 by the screws 24, 26 and serves both to close the device and to protect the intermediate plate 13 from the ink, particularly as the latter is drying. Thus, the intermediate plate still slides correctly even if the ink has thickened or dried, and the ink fountain remains sealed.

To hold the side wall 5 in place in the slideway 10, use is made of a screw 25, the end of which may be knurled to make it easier to tighten and slacken by hand.

To ensure a perfect seal, that is to say the absence of play, between the small plate made of hard material 12 and the intermediate plate 13, it is necessary to provide a special system for adjusting the position of the intermediate plate 13 sideways with respect to the slideway 10. One embodiment of this system is depicted in detail in FIG. 3 and comprises two inclined planes which collaborate in the manner of a wedge. A first inclined plane 30 is formed on the inside of the first plate 11 and a second inclined plane is formed on an intermediate part 31 which moves with respect to the first plate 11 by sliding along the first inclined plane 30, thus allowing the intermediate plate 13 to be adjusted sideways in the direction of the small plate of hard material 12 and allowing play to be eliminated. The wedge system is locked in place by the screws 27 which pass through oblong holes 28 in the intermediate part 31 and screw into the first plate 11 (see FIG. 2).

The wedge system can be adjusted by hand, by adjusting the position of the intermediate plate 13 toward the piece of hard material 12, little by little, or alternatively, use may be made of a system involving a cam 32 mounted on an axle fixed to the first plate 11 and actuated by the screw 33, the cam 32 acting on the intermediate part 31 so as to move it longitudinally in a direction perpendicular to the axis of the ink fountain roller 6 and thus, via the wedge system, move the intermediate plate 13 toward the piece of hard material 12.

Figure 3:
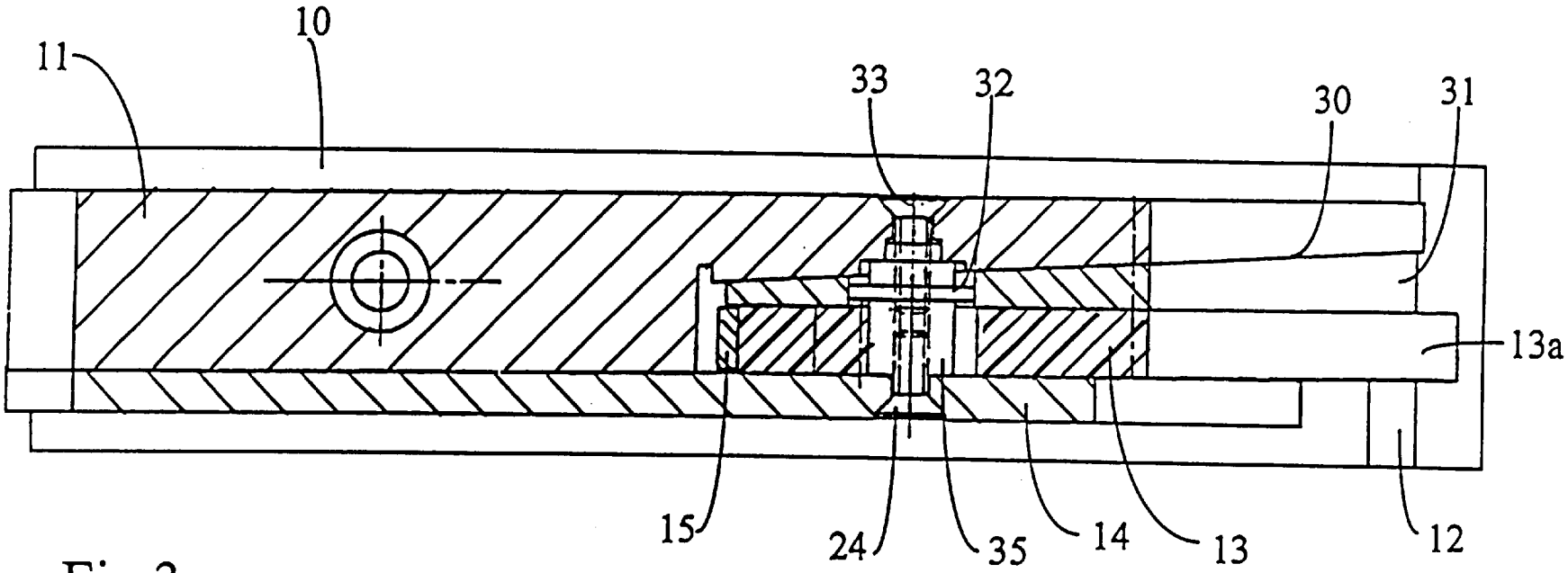
FIG. 3 shows a view from above in section on the axis III—III of the side wall of said FIG. 2.

To hold the intermediate plate 13 between the plates 11 and 14, the intermediate plate 13 is pierced with a hole through which a bushing 35 passes (see FIG. 3). This bushing 35 is itself held in position by screws 24 and 33 which pass through the plates 14 and 11 respectively.

The embodiment described is described by way of example and the side wall on the other side of the ink fountain 3 may be constructed in the same way as the one described hereinabove but as a symmetric inversion, so that the piece of hard material 12 and the plate 15 are on the inside of the ink fountain 3.

Furthermore, the invention is not restricted to the embodiment described and variations may be made within the scope of the claimed protection. For example, the intermediate plate may be adjusted sideways by other means equivalent to the wedge system described.

The materials used, particularly those of the small plate 12 and intermediate plate 13 which forms the seal may be varied.

The bottom 104 of the ink fountain is described in detail with reference to FIGS. 4 and 5. This bottom 4 is mounted on a transverse spindle 110 parallel to the axis of the ink fountain roller 6 and pivots about this spindle 110 toward the ink fountain roller 6 as the ink fountain is brought into operation. Blade segments 111 are mounted on the bottom 104. These segments 111 are connected to the bottom 104 by transverse slideways 113, 114 parallel to the spindle 110 supporting the bottom 104 and which are themselves fixed to said bottom 104 by means of screws 115 and 116. These transverse slideways 113, 114 have the overall shape of a T, the top of which is held in a corresponding slot 132, 133 cut in the segments 111. All the segments 111 may thus be mounted on the bottom 104 of the ink fountain by introducing them sideways into the transverse slideways 113 and 114 and, once they are all in place, they can then be moved at right angles to the spindle 110 of the ink fountain by virtue of the clearance that there is between the T-shaped top of the slideways 113, 114 and the corresponding slot 132, 133 of the segments.

At right angles to the slideways 113, 114, each segment 111 has housings 119, 120, in each of which a return spring 117, 118 is placed. These springs 117, 118, which work in compression, serve to keep the segment 111 in the position in which the edge of the segments 111 is closest to the ink fountain roller 6. This position may thus be defined as being a reference position, and the movement of the segments 111 in order to alter the thickness of ink applied to the roller 6 is performed by moving the sector 111 away from the roller 6.

The edge of the sector 111 is reinforced 112, for example by a wafer of hard material such as metal or ceramic which allows the life of each sector to be lengthened considerably. This is because the inks used have abrasive properties which wear the edge of the blade away. However, in order to maintain application of a precise thickness of ink to the roller 6, it is necessary for the blade to be sharp-edged. The use of reinforced sectors according to the present invention thus makes it possible, on the one hand, to reduce the wear on the edge and, on the other hand, for just one sector to be changed in the event of premature wear, rather than the entire blade, thus resulting in an appreciable saving.

There is a specific system provided for shifting each sector 111. This system comprises a cam 123 which, in FIG. 4, is associated with a motor 121. The cam 123 is placed in a corresponding slot 124 in the sector 111 and mounted on the spindle 122 of the motor 121. The motor 121 itself is mounted in the bottom of the ink fountain 104 and is fixed in by screws 125 and 126. The use of a motor as depicted in FIG. 4 in particular allows the movement of the sectors 111 to be controlled remotely. Thus, using an appropriate device, the position of each sector can be adjusted constantly to suit the quality of print produced, by combining the system described with computerized control means, for example. Of course, it is not necessary for the movement of the cams 123 to be motorized and it is possible to replace the motors 121 with a manual control acting on each cam 123.

Figure 5:
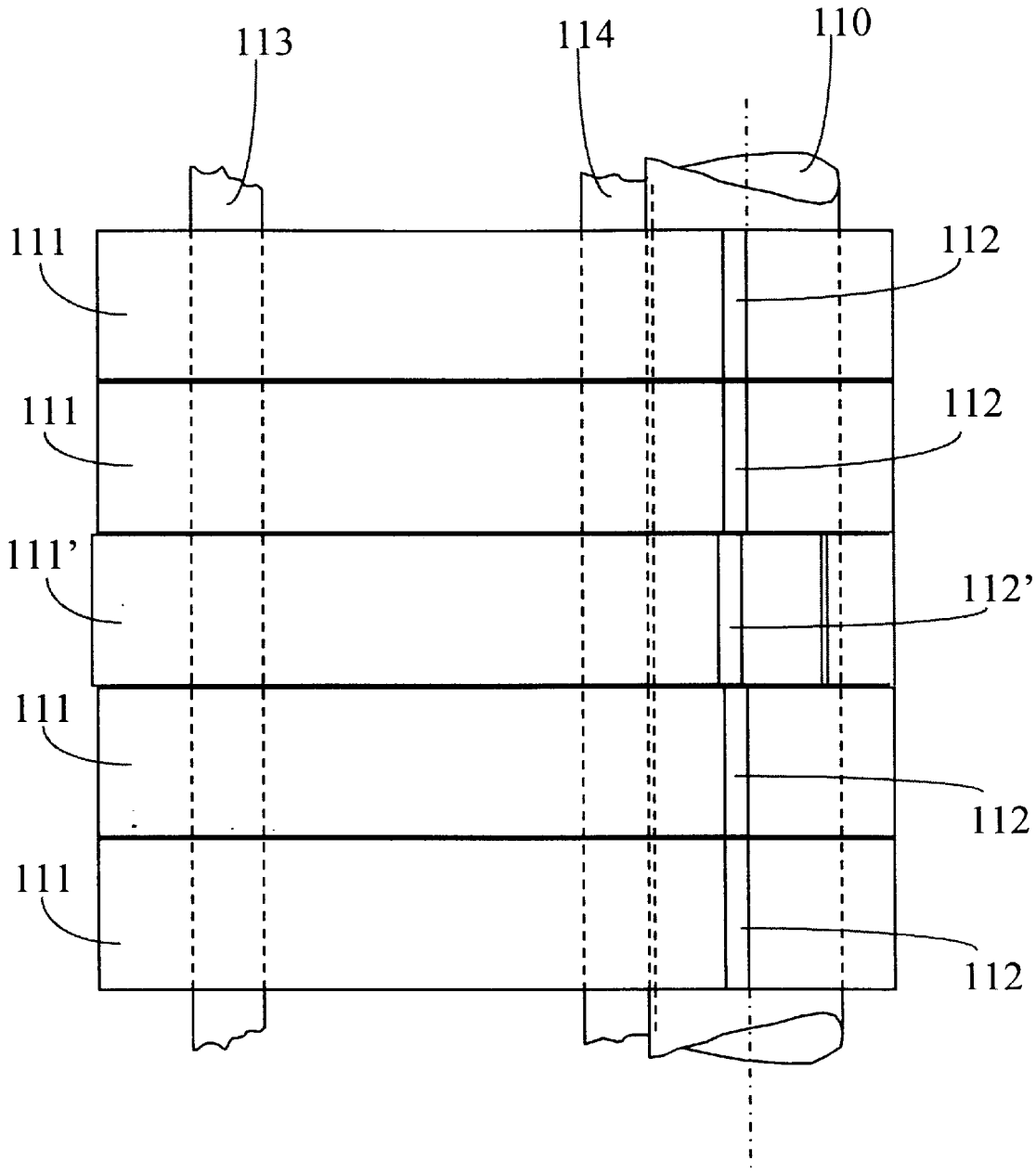
FIG. 5 shows a view from above of part of the ink fountain.

FIG. 5 diagrammatically depicts six adjacent sectors 111, 111' of an ink fountain. For a better understanding of the invention, the middle sector, referenced with the number 111', is depicted with an exaggerated offset. This offset thus allows the application over a determined width of a constant thickness of ink which is different than the thickness of ink applied by the adjacent sectors 111. According to the size of the pattern which than one sector 111 at a time, if the width of the pattern exceeds the width of one sector 111.

Advantageously, a blade with sectors 111 according to the invention can be used in an ink fountain comprising ink dividers. Such dividers are used to separate the colors when the ink fountain is used for multicolor printing. U.S. Pat. No. 4,991,504, the content of which is incorporated by reference, for example, describes an ink fountain including at least one such divider allowing inking with at least two different colors.

By attaching a divider directly to a sector 111, there is obtained a modular system in which any arbitrary sector as described hereinabove can be fitted with a divider so that the assembly allows numerous combinations.

Figure 6:
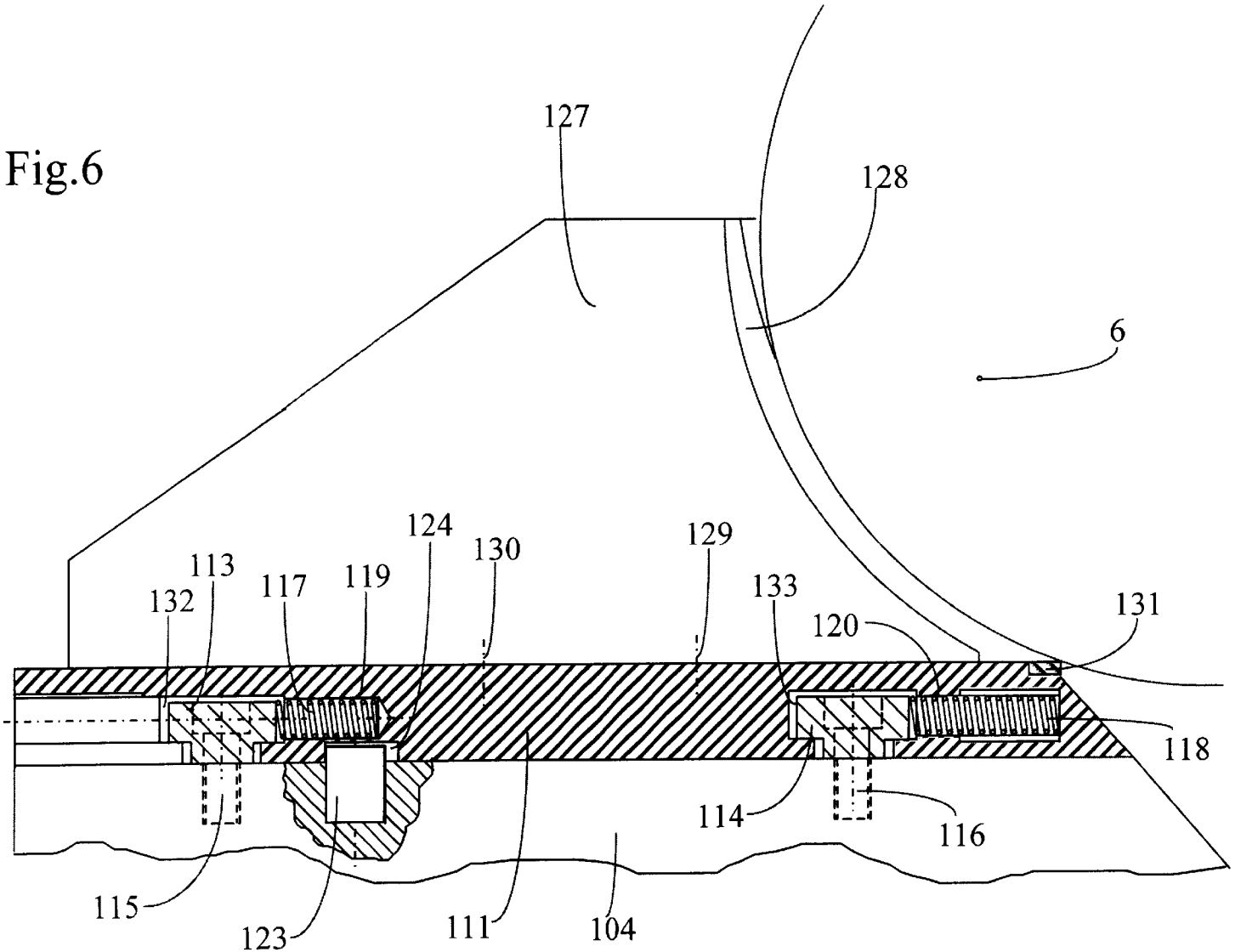
FIG. 6 depicts a dividing wall suitable for mounting in an ink fountain including a blade according to the invention.

FIG. 6 diagrammatically depicts a divider 127 mounted directly on a sector 111 according to the invention. The elements which are common to FIGS. 4 and 6 are identified with the same references. The divider 127, known per se for example from U.S. Pat. No. 4,991,504, comprises an intermediate plate 128 made of plastic, for example "NYLATRON" which is kept in contact with the periphery of the ink fountain roller 6 by press means (not depicted) such as springs, so that the contact remains leaktight.

Figure 4:
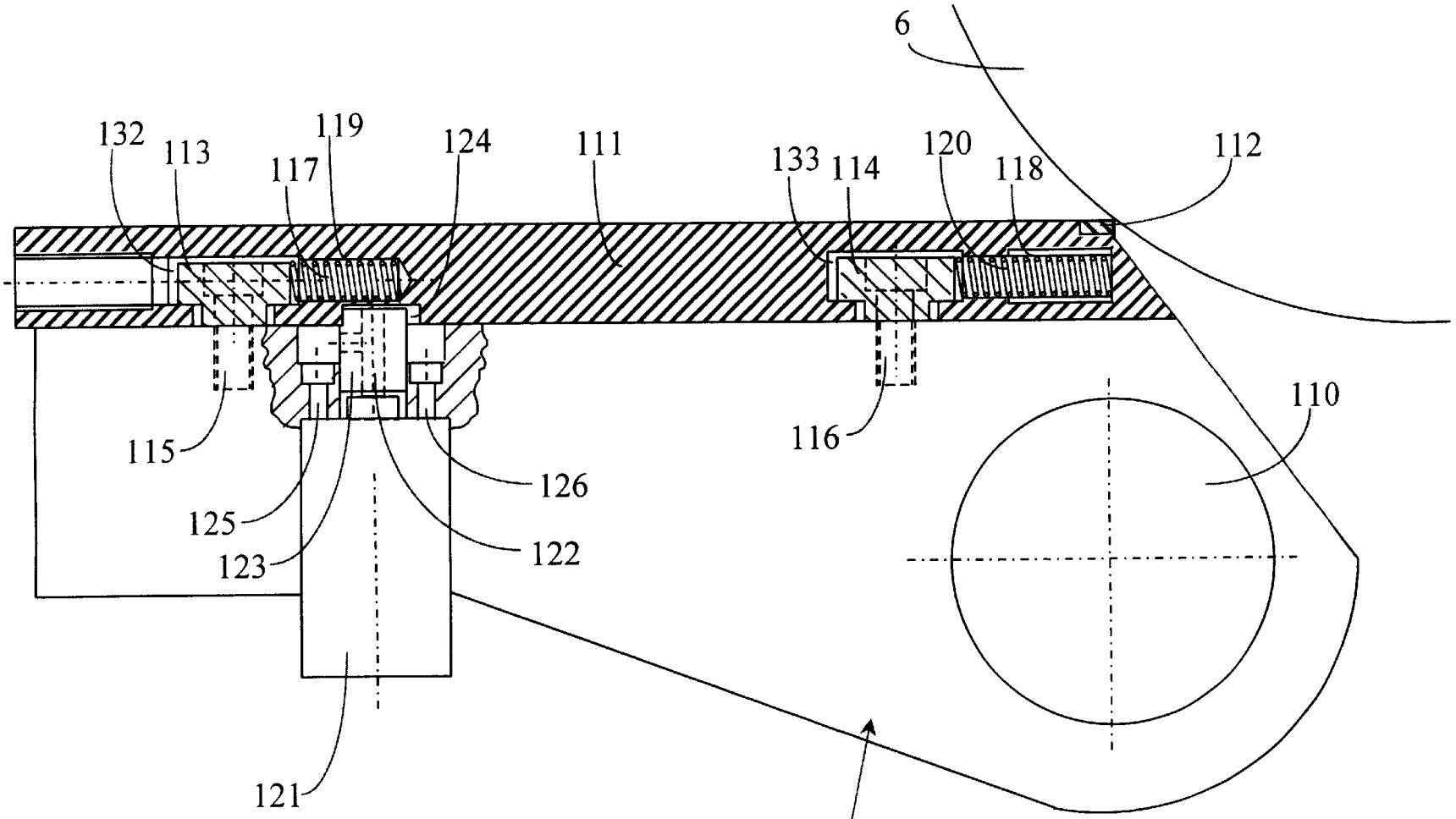
FIG. 4 shows a detailed view in part section of the bottom of an ink fountain.

If the divider 127 is not as wide as the segment 111 on which it is mounted, then the edge of the segment 111 on the same side as the ink fountain roller 6 needs to be reinforced, for example using a wafer of hard material 131 similar to the wafers 112 depicted in FIGS. 4 and 5. A wafer 131 of this kind will in fact be placed on each side of the intermediate plate 128. It will thus be possible to shift the segment so as to precisely adjust the thickness of ink applied in the vicinity of the intermediate plate 128 while at the same time maintaining sealed contact of this plate against the ink fountain roller 6, by virtue of the press means.

The embodiments of the invention are described by way of example and variations are possible within the scope of the claimed protection. For example, the number of slideways 113, 114 may be increased. It is also possible to envisage return means other than the springs 117, 118. Likewise, use may be made of another system equivalent to the system of cams used for moving the segments 111.

What is claimed is:

1. An ink fountain assembly for use with a printing machine, said ink fountain assembly comprising:

an ink fountain roller, a blade-shaped bottom having an edge contacting the ink fountain roller;

two side walls contacting said blade-shaped bottom, each side wall comprising at least two spaced-apart plates and an intermediate plate having a front edge in the shape of an arc of a circle which contacts said ink fountain roller; said intermediate plate of each side wall being mounted between said at least two spaced apart plates, each said intermediate plate being movable and tiltable with respect to said at least two spaced-apart plates, said front edge of said intermediate plate being biaised into contact with the outer circumferencial surface of said ink fountain roller by means of spring elements acting on said intermediate plate, each of said two side walls comprising a slideway in which said at least two spaced-apart plates and said intermediate plates are mounted on the bottom of said ink fountain; and each said slideway having a reinforcement member contacting the circumferencial surface of said ink fountain roller, each said reinforcement member comprising a small plate of hard material;

said ink fountain assembly further comprising a blade at the bottom of said ink fountain, said blade having an edge which maintains a desired thickness of ink on said ink fountain roller, said blade comprising multiple adjacent sectors which are shiftable towards and away from said ink fountain roller to vary the distance between said edge of said blade and said ink fountain roller, wherein said sectors are shiftable in the plane of said blade, parallel to each other.

2. The ink fountain assembly as claimed in claim 1, wherein each said sector has a reinforced edge for contacting said ink fountain roller.

3. The ink fountain assembly as claimed in claim 2, wherein said reinforced edge of each said sector is made by adding a part made of a hard material.

4. The ink fountain assembly as claimed in claim 3, wherein said distance between said edge of said blade and said ink fountain roller is varied by shifting said sector away from the circumference of said ink fountain roller.

5. The ink fountain assembly as claimed in claim 4, wherein said sector is shifted using a movable cam.

6. The ink fountain assembly as claimed in claim 5, wherein displacement of said cam is controlled manually or by a motor.

7. The ink fountain assembly as claimed in claim 6, wherein at least one return spring clement (117, 118) urges each of said sectors toward said ink fountain roller.

8. The ink fountain assembly as claimed in claim 7, which comprises at least one dividing wall mounted on one of said sectors for separating said ink fountain assembly into compartments each containing inks of different colors.

9. The ink fountain assembly as claimed in claim 8, wherein said side walls are mounted on end sectors of said blade.

* * * * *